US007435209B2

(12) United States Patent
Kimura et al.

(10) Patent No.: US 7,435,209 B2
(45) Date of Patent: Oct. 14, 2008

(54) CONTACT-BONDING FILM INSERTION MEANS INCLUDED IN CONTACT-BONDING PAPER MANUFACTURING APPARATUS

(75) Inventors: Yoshikazu Kimura, Kyoto (JP); Masato Tsuchiya, Kyoto (JP)

(73) Assignee: KDK Co., Ltd. (JP)

( * ) Notice: Subject to any disclaimer, the term of this patent is extended or adjusted under 35 U.S.C. 154(b) by 499 days.

(21) Appl. No.: 10/518,023

(22) PCT Filed: Jun. 23, 2003

(86) PCT No.: PCT/JP03/07969

§ 371 (c)(1),
(2), (4) Date: Jun. 15, 2005

(87) PCT Pub. No.: WO2004/002749

PCT Pub. Date: Jan. 8, 2004

(65) Prior Publication Data

US 2005/0253321 A1 Nov. 17, 2005

(30) Foreign Application Priority Data

Jun. 26, 2002 (JP) ..... 2002-222180
Nov. 29, 2002 (JP) ..... 2002-382853
Dec. 27, 2002 (JP) ..... 2002-383792

(51) Int. Cl.
*B31B 1/14* (2006.01)
*B31B 1/36* (2006.01)
*B42D 15/02* (2006.01)

(52) U.S. Cl. ..... 493/223; 156/443; 156/470; 156/475; 156/522; 156/555; 493/231; 493/345; 493/350; 493/380; 493/390

(58) Field of Classification Search ..... 53/545, 53/558, 564, 569, 389.1; 493/210, 223, 227, 493/231, 343, 344, 345, 350, 357, 360, 374, 493/379, 380, 390, 393, 394, 416; 156/443, 156/464, 468, 470, 475, 483, 484, 522, 555, 156/582

See application file for complete search history.

(56) References Cited

U.S. PATENT DOCUMENTS 3,733,770 A * 5/1973 Erickson et al. ..... 53/564

(Continued)

FOREIGN PATENT DOCUMENTS

JP 4-179596 A 6/1992

(Continued)

*Primary Examiner*—Stephen F. Gerrity
(74) *Attorney, Agent, or Firm*—Banner & Witcoff, Ltd.

(57) ABSTRACT

A contact-bonding film insertion device included in a contact-bonded paper manufacturing apparatus which produces releasable and expandable contact-bonded paper such as postcards (Q) by inserting a contact-bonding film (F) carried on a vertically movable support plate (51) between opposed paper pieces (Pa, Pb) of folded cut paper (P) by a paper pushing device (60), the cut paper (P) having been transferred by a paper transfer device (20) and folded by a paper folding device (30), and subsequently by extracting the support plate (51) from the paper piece (Pa, Pb) by a support plate extracting device (55) to supply the paper (P) into which only the contact-bonding film F is inserted to a paper contact-bonding device (70) and paper cutting device (80), a slope (51*y*) which is downward-inclined toward its tip to form substantially an acute angle at the tip is provided on a periphery (51*x*) of the support plate (51) included in the contact-bonding film insertion device, the periphery (51*x*) which includes the slope (51*y*) having a shape being preferably curved upward with respect to the main body of the support plate (51). This structure allows smooth insertion of the contact-bonding film (F) between the paper piece (Pa, Pb) without occurrence of jamming or other problem even if the paper (P) is extremely curled to have concave and convex deformations on its surface through printing or other process.

20 Claims, 15 Drawing Sheets

U.S. PATENT DOCUMENTS 4,662,960 A * 5/1987 Jost et al. ..... 156/522
4,934,128 A * 6/1990 Savio et al. ..... 53/564
5,403,428 A * 4/1995 Shingo et al. ..... 493/381

FOREIGN PATENT DOCUMENTS

JP 04-250031 A * 9/1992
JP 05-038894 A * 2/1993
JP 08-090962 A * 8/1996
JP 9-76665 A 3/1997
JP 2002-120478 A * 4/2002
JP 2003-103967 A 4/2003

* cited by examiner

CONTACT-BONDING FILM INSERTION MEANS INCLUDED IN CONTACT-BONDING PAPER MANUFACTURING APPARATUS

This application is a U.S. National Stage application of co-pending PCT application PCT/JP03/007969 filed Jun. 23, 2003, which claims the priority of Japanese Patent Application No. 2002-222180, filed Jun. 26, 2002; Japanese Patent Application No. 2002-382853, filed Nov. 29, 2002; and Japanese Patent Application No. 383792, filed Dec. 27, 2002. These applications are incorporated herein by reference in there entireties.

TECHNICAL FIELD

The present invention relates to contact-bonded paper manufacturing apparatus which uses cut paper for manufacturing contact-bonded paper available for the production of direct mails, postcards, double postcards, sealed letters and so forth. More specifically, the invention relates to contact-bonding film insertion means included in contact-bonded paper manufacturing apparatus for manufacturing contact-bonded paper from cut paper which is folded into multiple layers and releasably contact-bonded with a contact-bonding film interposed between the layers, whereby a large volume of information can be concealed inside the paper in spite of ordinary appearances as direct mails, postcards, double postcards, sealed letters and the like.

BACKGROUND ART

Recently, contact-bonded paper has been used for increasing numbers of postal matters such as postcards so as to transmit a large quantity of information. The contact-bonded paper is manufactured by: folding paper which is formed by a plurality of paper pieces including information and connected with each other along folding lines; and subsequently contact-bonding the opposed paper pieces such that each piece is releasable.

For example, JP-A-5-38894 and JP-A-9-76665 propose apparatus for manufacturing such type of contact-bonded paper which basically includes: paper transfer means for sequentially transferring each paper from a paper supply section along a predetermined paper transfer path, which paper is formed by connecting a plurality of paper pieces along folding lines; paper folding means for folding each paper on the paper transfer path; contact-bonding film supply means for sequentially supplies an elongated contact-bonding film along a predetermined contact-bonding film supply path, which contact-bonding film includes two-layered transparent film each layer of which is releasably bonded to each other and bonding layers each disposed on front and back surfaces of the contact-bonding film to provide adhesion when heated or pressurized; contact-bonding film insertion means for inserting the contact-bonding film between any opposed paper pieces of the folded paper at an intersection of the paper transfer path downstream from the paper folding means and the contact-bonding film supply path; paper contact-bonding means for releasably bonding both the paper pieces of the paper into which the contact-bonding film is inserted while being pressurized or while being heated and pressurized with the contact-bonding film interposed between the paper pieces on the paper transfer path downstream from the contact-bonding film insertion means; and paper cutting means for cutting the paper into which the contact-bonding film is inserted to a predetermined size on the paper transfer path upstream or downstream from the paper contact-bonding means.

When the contact-bonded paper manufactured by the apparatus is opened from the paper pieces thus contact-bonded, the two layers of the transparent film inserted between the paper pieces are separated from each other, whereby the contact-bonded paper is expanded with the information surface of each paper piece simultaneously covered with the transparent film in such a condition that the information on each paper piece is visually recognizable through the transparent film.

The contact-bonded paper has high concealability such as privacy protection since the information on each paper piece is not visually recognized from outside until the paper is released and expanded by a receiver. Additionally, transmission cost for a fixed volume of information is greatly reduced since much more information can be transmitted by the contact-bonded paper at normal charge than by a single piece of mail. Furthermore, as the information on each piece is covered with the transparent film, preservation, water-resistance and dirt-resistance of the information is enhanced and also the appearance of the information is improved, which promotes information transmission and advertisement activities and offers other advantages.

However, the above-described apparatuses are generally mass-production types, which are appropriate for the production of notices transmitted to a great number of members from large entities such as mail-order selling companies or correspondence schools. When medium or small-sized enterprises use the large-scale manufacturing apparatus of these types to send notices to a small number of members at regular intervals, for example, the unit cost for manufacturing the contact-bonded paper drastically rises and it is thus difficult to employ the apparatus for the production of the contact-bonded paper in small lots.

Especially, contact-bonded paper manufacturing apparatus disclosed in JP-A-5-38894 uses continuous form paper and thus requires a specialized continuous form printer for printing the continuous form paper. However, printers such as those generally used for the output of personal computers in medium or small-sized companies or at home are unavailable for printing the continuous form paper.

Contact-bonded paper manufacturing apparatus disclosed in JP-A-9-76665 uses non-continuous cut paper transferred one by one, and thus the above problem does not arise. However, contact-bonding film insertion means included in the apparatus requires a complicated process of continuously inserting a contact-bonding film between opposed paper pieces of transferred paper at the step of folding the paper while supplying the contact-bonding film at the same speed as that of the paper.

Development of an invention pertaining to contact-bonded paper manufacturing apparatus which uses cut paper and has a simple and miniaturized structure and whose means for inserting contact-bonding film between paper pieces is particularly improved has been completed by JDL Engineering Co., LTD. with the cooperation of the applicant of the present invention, and the application of this invention was filed on May 2, 2002, with the application No. 2001-296979. This patent application is currently co-owned by JDL Engineering Co., LTD and KDK Co., LTD that is the applicant of the present invention.

Contact-bonding film insertion means included in the contact-bonded paper manufacturing apparatus disclosed in patent application No. 2001-296979 includes: a support plate disposed at the intersection of a paper transfer path downstream from paper folding means and contact-bonding film supply path to be vertically movable and carry a supplied contact-bonding film on its upper surface; support plate driving means for vertically moving the support plate, which driving means lowers the support plate and the contact-bonding film as one body and thereby pushes down a lower paper piece so as to forcedly open a space between paper pieces when paper folded such that the lower paper piece is slightly longer than the upper paper piece is transferred to the intersection and the upper paper piece of the paper is disposed upstream from the support plate and the lower paper piece is disposed below the support plate; and paper pushing means for pushing the paper having an open space between the paper pieces to the support plate carrying the contact-bonding film and thereby simultaneously inserting the support plate and the contact-bonding film into the space between the paper pieces. The apparatus practically requires support plate extracting means for extracting only the support plate from the paper into which the support plate and the contact-bonding film have been inserted and thereby leaving only the contact-bonding film inserted between the paper pieces.

DISCLOSURE OF THE INVENTION

The present inventors repeatedly carried out their own experiments concerning the contact-bonding film insertion means having the above structure under various conditions, and found that the contact-bonding film insertion means using a support plate has the following problem. When paper which is heated to high temperature during printing in some types of printers, some methods of printing and some printing conditions is extremely curled to have concave and convex deformations on its surface, the upper paper piece of the folded paper becomes wavy and hangs down toward the lower paper piece. In this case, the space between the paper pieces is not sufficiently opened when the lower paper piece is pushed down by the downward movement of the support plate as described above, and thus the contact-bonding film is not smoothly inserted between the paper pieces in the manner as described above.

Wherefore, it is an object of the present invention to provide contact-bonding film insertion means included in contact-bonded paper manufacturing apparatus using cut paper and capable of smoothly inserting a contact-bonding film between paper pieces of folded paper without occurrence of jamming or other problem even if paper curled to have concave and convex deformations on its surface due to printing is used.

A first aspect of the present invention is contact-bonding film insertion means included in contact-bonded paper manufacturing apparatus which comprises: paper transfer means for sequentially transferring cut paper from a paper supply section along a predetermined paper transfer path, which cut paper is formed by connecting a plurality of paper pieces with each other along folding lines; paper folding means for folding each paper on the paper transfer path; contact-bonding film supply means for sequentially supplying an elongated contact-bonding film along a predetermined contact-bonding film supply path, which contact-bonding film includes a two-layered transparent film whose layers are releasably bonded to each other and adhesive layers each disposed on front and back surfaces of the contact-bonding film to provide adhesion when pressurized or when heated and pressurized; contact-bonding film insertion means for inserting the contact-bonding film between any opposed paper pieces of the folded paper at an intersection of the paper transfer path downstream from the paper folding means and the contact-bonding film supply path; paper contact-bonding means for releasably bonding both the paper pieces of the paper into which the contact-bonding film is inserted, via the contact-bonding film by pressurizing or by heating and pressurizing on the paper transfer path downstream from the contact-bonding film insertion means; and paper cutting means for cutting the paper into which the contact-bonding film is inserted to a predetermined size on the paper transfer path upstream or downstream from the paper contact-bonding means, the contact-bonding film insertion means having a structure which includes:

a vertically movable support plate disposed at the intersection to carry the supplied contact-bonding film on its upper surface; support plate driving means capable of driving the support plate in the vertical direction for lowering the support plate and the contact-bonding film as one body and thereby pushing down a lower paper piece so as to forcedly open a space between the paper pieces when the paper folded such that the lower paper piece is slightly longer than the upper paper piece is transferred to the intersection and the upper paper piece of the paper is disposed upstream from the support plate and the lower paper piece is disposed below the support plate; paper pushing means for pushing the paper having an open space between the paper pieces to the support plate carrying the contact-bonding film and thereby simultaneously inserting the support plate and the contact-bonding film between the paper pieces; and support plate extracting means for extracting only the support plate from the paper into which the support plate and the contact-bonding film have been inserted and thereby leaving only the contact-bonding film inserted between the paper pieces, characterized in that a periphery of the support plate on the side to be inserted between the paper pieces has a slope which is downward-inclined toward the tip of the periphery to form substantially an acute angle at the tip.

According to the above structure, the acute-angled tip of the slope formed in the periphery of the support plate is inserted into the open space between the paper pieces as the paper having the open space between the paper pieces is pushed toward the support plate carrying the contact-bonding film by the paper pushing means. The upper paper piece slidingly overrides the slope of the support plate due to the wedge shape of the slope, thereby forcedly opening the space between the paper pieces. Accordingly, the support plate and the contact-bonding film can be smoothly inserted between the paper pieces.

In the above structure, even if the paper is curled to have concave and convex deformations on its surface due to printing and thereby the upper paper piece hangs down and the space between the paper pieces is insufficiently opened after the operation of the support plate driving means, the tip of the slope of the support plate is easily inserted into the insufficiently opened space between the paper pieces, thereby raising the upper paper piece utilizing its wedge shape and forcedly opening the space between the paper pieces.

In the above structure, when the slope extends above the periphery of the support plate on the side to be inserted between the paper pieces, more preferably when the slope extends above the periphery of the contact-bonding film carried on the support plate on the side to be inserted between the paper pieces, the upper paper piece slidingly overrides the slope of the support plate, further passes through the top of the slope and overrides the upper surface of the contact-bonding film with ease. Accordingly, the support plate and the contact-bonding film can be more smoothly inserted between the paper pieces.

The cut paper to be supplied to the contact-bonding film insertion means is not only the simplest type of paper formed by folding two paper pieces connected with each other into two layers, but may be such paper which is formed by folding three paper pieces connected with one another into three layers in a zigzag direction having a Z-shaped cross section or in a single direction having a C-shaped cross section, by folding four or more paper pieces connected with one another in a zigzag direction in the shape of a bellows or in a single direction in the shape of a roll, by folding the paper pieces from both sides toward the center like double doors opening outwards, or by folding the paper pieces by a mixture of the above methods. The contact-bonding film can be inserted between any opposed paper pieces of paper of any types described above. The material of the paper is not limited to ordinary paper, but may be synthetic paper, plastic films and sheets, cloth, and other sheets in a variety of fields.

The paper transfer means, the paper folding means, the contact-bonding film supply means, the paper contact-bonding means, and the paper cutting means are not specifically limited but may be known means. Since the paper cutting means cuts the paper which contains the elongated contact-bonding film inserted into the space between the paper pieces to a predetermined size, the paper cutting means cuts the paper pieces as well as the contact-bonding film as necessary. The paper into which the contact-bonding film is inserted may be supplied from the paper contact-bonding means to the paper cutting means, or may be supplied from the paper cutting means to the paper contact-bonding means, depending on the necessities.

The material of the support plate used in the contact-bonding film insertion means is not specifically limited as long as it has appropriate strength and flatness for carrying the contact-bonding film on its upper surface and inserting the contact-bonding film between the paper pieces as described above, and thus metal, plastic, ceramic and other material and composite materials of these may be used. The vertical movement of the support plate may be achieved preferably via a support shaft. When the support plate is made from ferromagnetic metal such as stainless steel or composite material of those metals and other materials, a simple structure in which the support plate is vertically moved by exciting and de-exiting an electromagnet can be adopted. When the support plate is movable via the support shaft as described above, a structure that rotates the support shaft so as to move the support plate may be adopted as the support plate driving means, for example.

The function of the paper pushing means included in the contact-bonding film insertion means may be performed by the paper transfer means for transferring the folded paper to the intersection of the paper transfer path and the contact-bonding film supply path, for example. Alternatively, the paper pushing means may be performed by paper shifting means for shifting the paper having been pushed by the paper transfer means to a certain position to the final position, the paper shifting means and the paper transfer means cooperating with each other. The paper shifting means may have a structure that pushes the rear end of the folded paper to a predetermined position shaft by moving a bar through a predetermined angle via a support, for example.

The support plate extracting means included in the contact-bonding film insertion means may have the following structure, for example. A notch is provided on the support plate, and a pair of feed rollers is opposed to each other at the position of the notch above and below the support plate. The paper containing the support plate and the contact-bonding film completely inserted between the paper pieces is pressed by a pair of the feed rollers from above and below at the intersection, while being transferred downstream from the intersection by the rotation of the feed rollers. Consequently, the support plate positioned at the notch is not pressed nor transferred by the feed rollers but remains at the intersection, whereby the paper containing only the contact-bonding film inserted between the paper pieces can be transferred from the intersection.

The shape, the formation method and other conditions of the slope formed in the periphery of the support plate are not specifically limited as long as the slope can raise the upper paper piece to forcedly open the space between the paper pieces by utilizing its wedge shape in accordance with the operation of the paper pushing means as described above. The slope may have a linear or curved cross section, or a mixture of these cross sections, for example. The slope may extend above or below the periphery of the support plate on the side to be inserted between the paper pieces. The slope may be formed integrally with the periphery of the support plate, or formed by a separate component attached to the periphery of the support plate, such as a separate component having a wedge-shaped cross section. The separate component may be made from not only the material of the support plate but also other materials such as metal, plastic, ceramic, paper, cloth, and synthetic paper.

In addition, in the periphery of the support plate in which the slope is formed, a contact portion in the shape such as step, edge, or bended shape may be disposed adjacent to the rear of the slope for guiding the periphery of the contact-bonding film on the side to be inserted between the paper pieces. The contact portion allows the contact-bonding film to be positioned with respect to the support plate in a more stable and reliable manner. The height of the contact portion is not required to exceed the height of the upper surface of the contact-bonding film to be guided.

When the slope extends above the periphery of the support plate on the side to be inserted between the paper pieces or further extends above the periphery of the contact-bonding film carried on the support plate on the side to be inserted between the paper pieces as described above, there is a difference in height between the top of the slope and the periphery of the support plate or the contact-bonding film. In this arrangement, the contact portion can be easily formed adjacent to the rear of the slope. The tip of the slope formed in the periphery of the support plate may be chamfered or processed to have an R shape or a mixture of those shapes within a range where the expected functions and advantages of the slope are not deteriorated, for the purpose of prevention of danger and damage of the paper caused by the acute-angled tip of the slope.

In the contact-bonding film insertion means as described above, the problem that the space between the paper pieces is not sufficiently opened due to the hanging-down condition of the upper paper piece can be solved by providing the slope which is disposed in the periphery of the support plate and is downward-inclined toward its tip to form substantially an acute angle at the tip. However, if paper which has been curled due to printing is transferred to the intersection in the condition where the lower paper piece is greatly curved upward, the periphery of the lower paper piece is not inserted below the support plate as desired but overrides the periphery and thus the slope of the support plate. As a result, the lower paper piece cannot be pushed down by the downward movement of the support plate effected by the support plate driving means, and thus the subsequent step of inserting the support plate and the contact-bonding film between the paper pieces cannot be carried out.

This problem can be solved by contact-bonding film insertion means included in contact-bonded paper manufacturing apparatus in a second aspect of the invention. In the contact-bonding film insertion means which uses a support plate having a slope in its periphery, the periphery having the slope is curved upward with respect to the main body of the support plate, thereby providing a wide open space below the support plate.

According to the above structure, when the lower paper piece of the folded paper is transferred to the intersection in the condition that the periphery of the lower paper piece is curved upward, the lower paper piece can easily slide into the wide open space below the periphery of the support plate which is curved upward. Thus, the lower paper piece can be pushed down by the downward movement of the support plate and subsequently the support plate and the contact-bonding film can be normally inserted between the paper pieces utilizing the wedge shape of the slope.

The curved shape of the periphery of the support plate in which the slope is formed is not specifically limited as long as the slope has the advantage of the wedge shape and the periphery of the support plate allows the lower paper piece curved upward to slide below the periphery. The cross section of the curved periphery may be linear or curved, or a mixture of these shapes.

Contact-bonding film insertion means included in contact-bonded paper manufacturing apparatus in a third aspect of the present invention is also developed to solve the problem which occurs when paper curled due to printing is transferred to the intersection in the condition that the periphery of the lower paper piece is greatly curved upward. In the structure of the contact-bonding film insertion means which uses a support plate having a slope formed in its periphery, the periphery of the support plate in which the slope is formed is temporarily raised by the support plate raising means before the lower paper piece of the paper transferred to the intersection reaches the support plate, thereby providing a wide open space below the support plate at the time the open space is required.

According to the above structure, when the lower paper piece of the folded paper is transferred to the intersection in the condition that the periphery of the lower paper piece is curved upward, the lower paper piece can easily slide into the wide open space below the periphery of the support plate which is curved upward by the support plate raising means. Thus, the lower paper piece can be pushed down by the downward movement of the support plate and subsequently the support plate and the contact-bonding film can be normally inserted between the paper pieces utilizing the wedge shape of the slope.

The support plate having the slope on its periphery may be either the one included in the contact-bonding film insertion means in the first aspect or the one included in the contact-bonding film insertion means in the second aspect. When the latter type of the support plate is adopted, the periphery of the support plate that is curved upward is further raised by the support plate raising means. Thus, a wider open space below the support plate can be provided for the lower paper piece of the paper transferred to the intersection.

The support plate raising means may be a structure in which the support plate is raised by a push rod disposed below the support plate and driven by driving means such as solenoid and other electromagnetic means and mechanical means to raise the support plate, a structure in which the support plate is raised by the rotation of the support shaft when the support plate is movable via the support shaft, a structure in which the function of the support plate driving means is expanded such that it can raise the support plate, or other structures.

BEST MODE FOR CARRYING OUT THE INVENTION

Embodiments of the present invention are hereinafter described with reference to the appended drawings, while comparing these embodiments with a basic technique prior to improvement.

Figure 6:
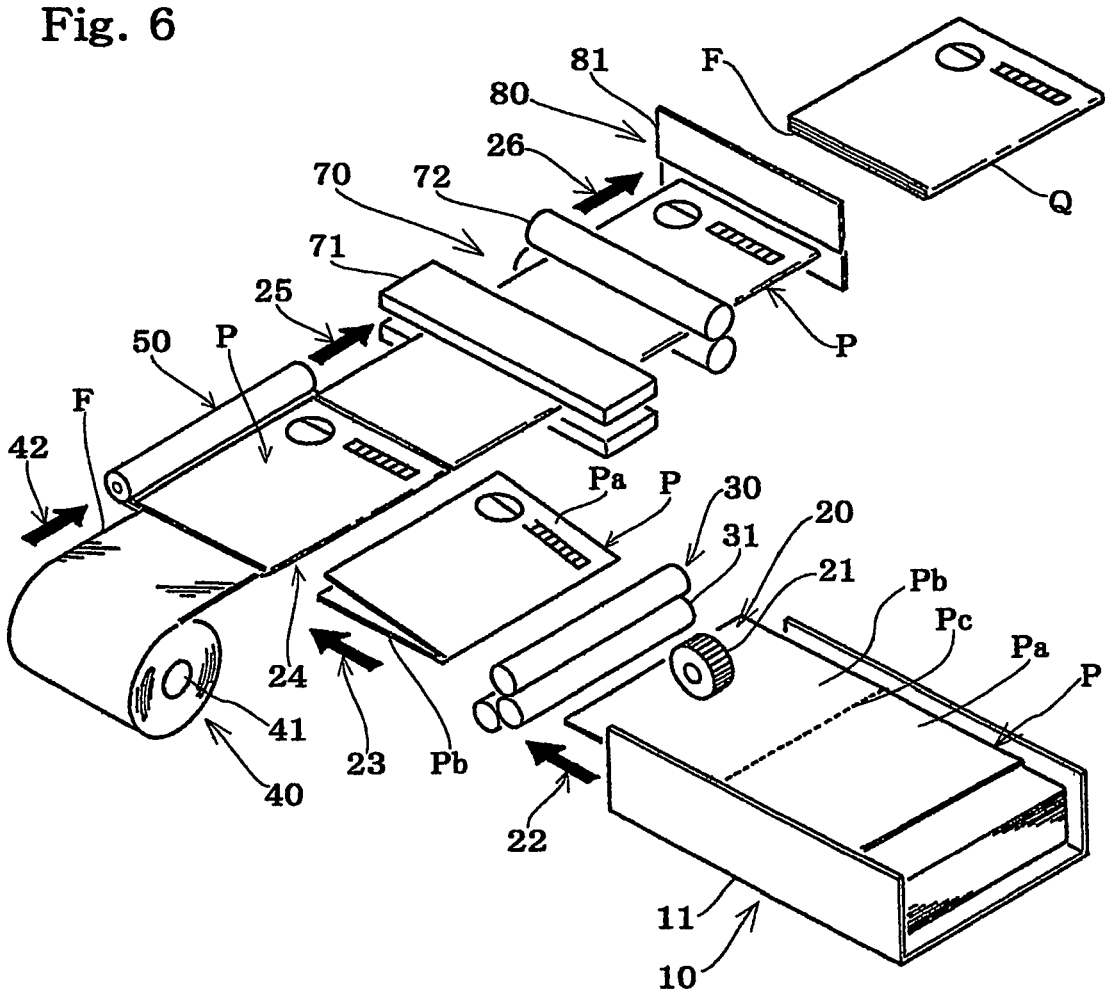
FIG. 6 is a conceptual perspective view illustrating a main part of contact-bonded paper manufacturing apparatus for cut paper that includes contact-bonding film insertion means using a support plate.

(1) Entire Structure of Contact-bonded Paper Manufacturing Apparatus using Cut Paper In contact-bonded paper manufacturing apparatus using cut paper to which contact-bonding film insertion means using a support plate is applicable, cut paper P is piled and accommodated in a stocker 11 of a paper supply section 10 as illustrated in FIG. 6. Each paper P has a plurality of paper pieces Pa and Pb connected to each other along a folding line Pc. Each paper P is sequentially taken out from the stocker 11 by a feed roller 21 which partially constitutes a series of paper transfer means 20 and is transferred downstream along a predetermined paper transfer path 22 indicated by an arrow in an upper left direction. Subsequently, the paper P is folded into two layers by folding rollers 31 which constitute paper folding means 30 and is transferred further downstream along a predetermined paper transfer path 23 indicated by an arrow in the upper left direction.

An elongated contact-bonding film F includes two-layered transparent film each layer of which is releasably bonded to each other and adhesive layers each disposed on front and back surfaces of the film F to provide adhesion when pressurized or when heated and pressurized. The film F is sequentially supplied from a film roll 41 that constitutes contact-bonding film supply means 40 along a predetermined contact-bonding film supply path 42 indicated by an arrow in an upper right direction.

The paper P folded by the paper folding means 30 is transferred to an intersection 24 of the paper transfer path 23 downstream from the paper folding means 30 and the contact-bonding film supply path 42, where the paper P is supplied to contact-bonding film insertion means 50 illustrated in detail in FIGS. 7A and 7B through 12.

The paper P passing through the contact-bonding film insertion means 50 in a condition that the contact-bonding film F is inserted between the paper pieces Pa and Pb is transferred from the intersection 24 along downstream paper transfer paths 25 and 26 indicated by arrows in the upper right direction as illustrated in FIG. 6. The paper P is subsequently transferred to a heat panel 71 and pressure rollers 72 each constituting paper contact-bonding means 70, and to a cutter 81 constituting paper cutting means 80 in this order, thereby manufacturing contact-bonded paper Q such as postcards.

Figure 7A:
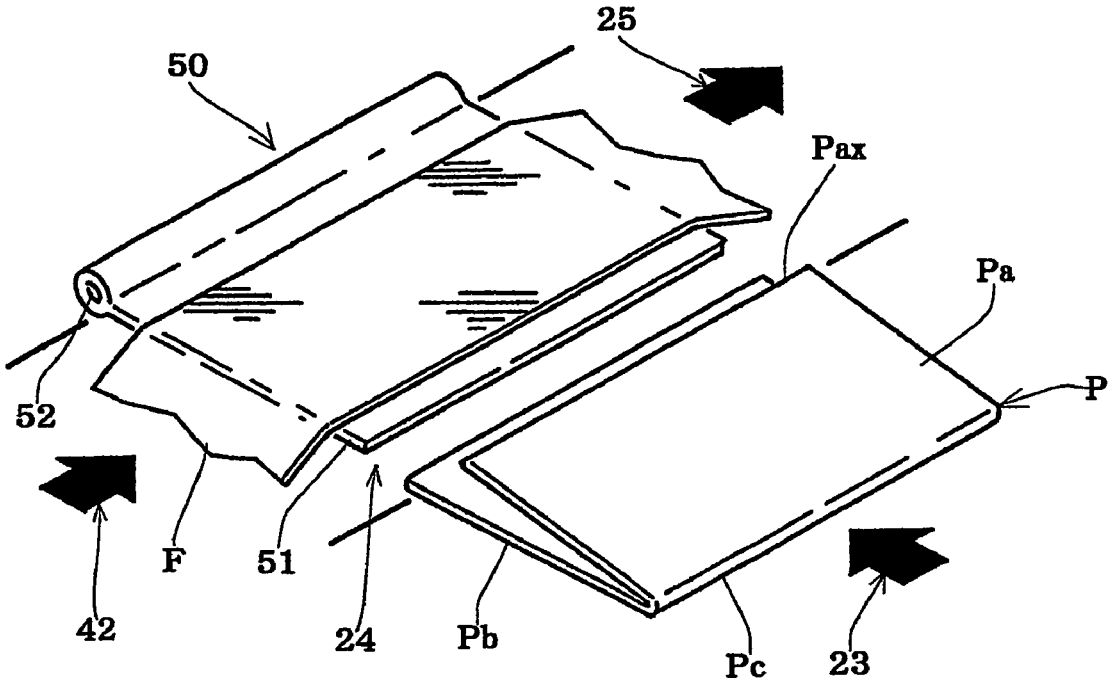
FIGS. 7A and 7B are conceptual perspective view each illustrating a positional correlation between paper and a contact-bonding film in the contact-bonding film insertion means using a support plate as viewed from different positions.
Figure 7B:
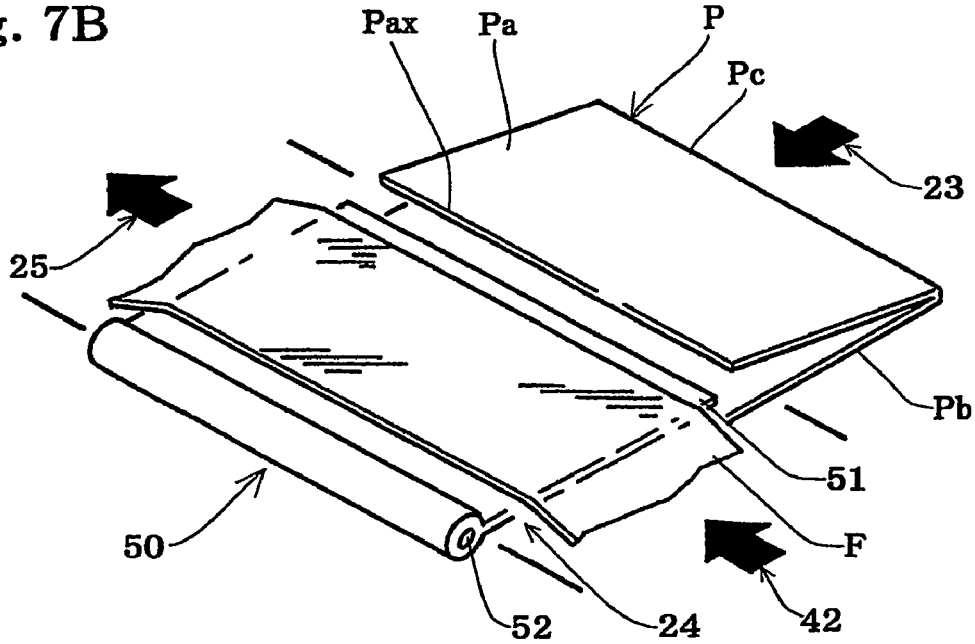
Figure 8A:
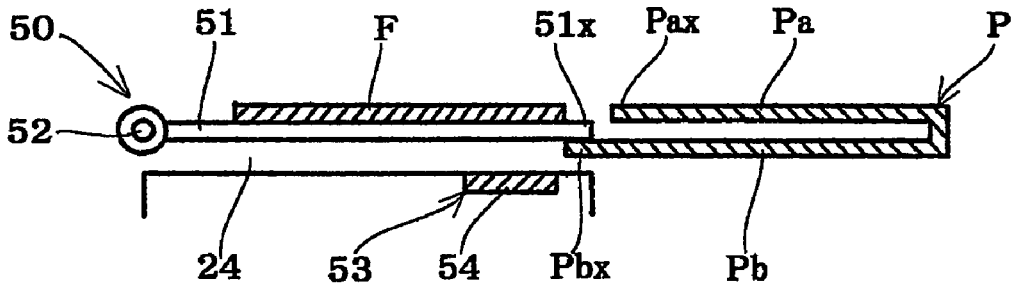
FIGS. 8A through 8D are conceptual side views each illustrating a main part of a mechanism for inserting a contact-bonding film into paper with the elapse of time in the contact-bonding film insertion means using a support plate.
Figure 8B:
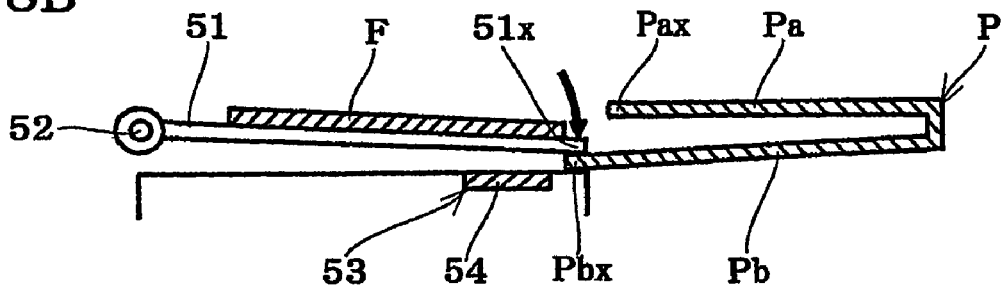
Figure 9A:
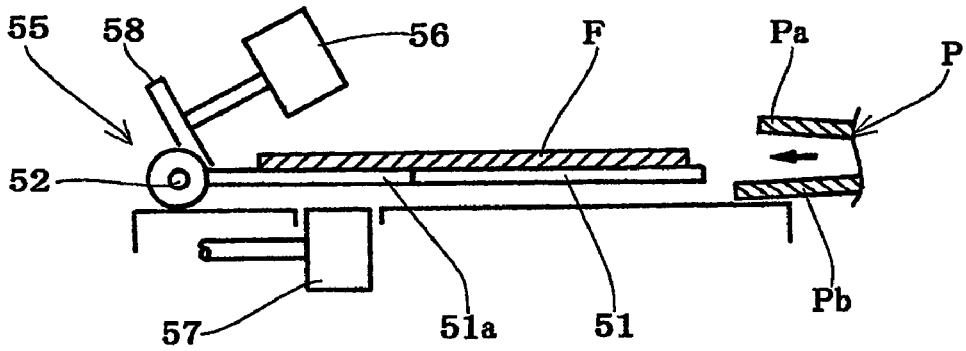
FIGS. 9A and 9B are a longitudinal cross-sectional view and a perspective view, respectively, each illustrating a main part of support plate extracting means to be employed in the contact-bonding film insertion means using a support plate prior to operation of the support plate extracting means.
Figure 9B:
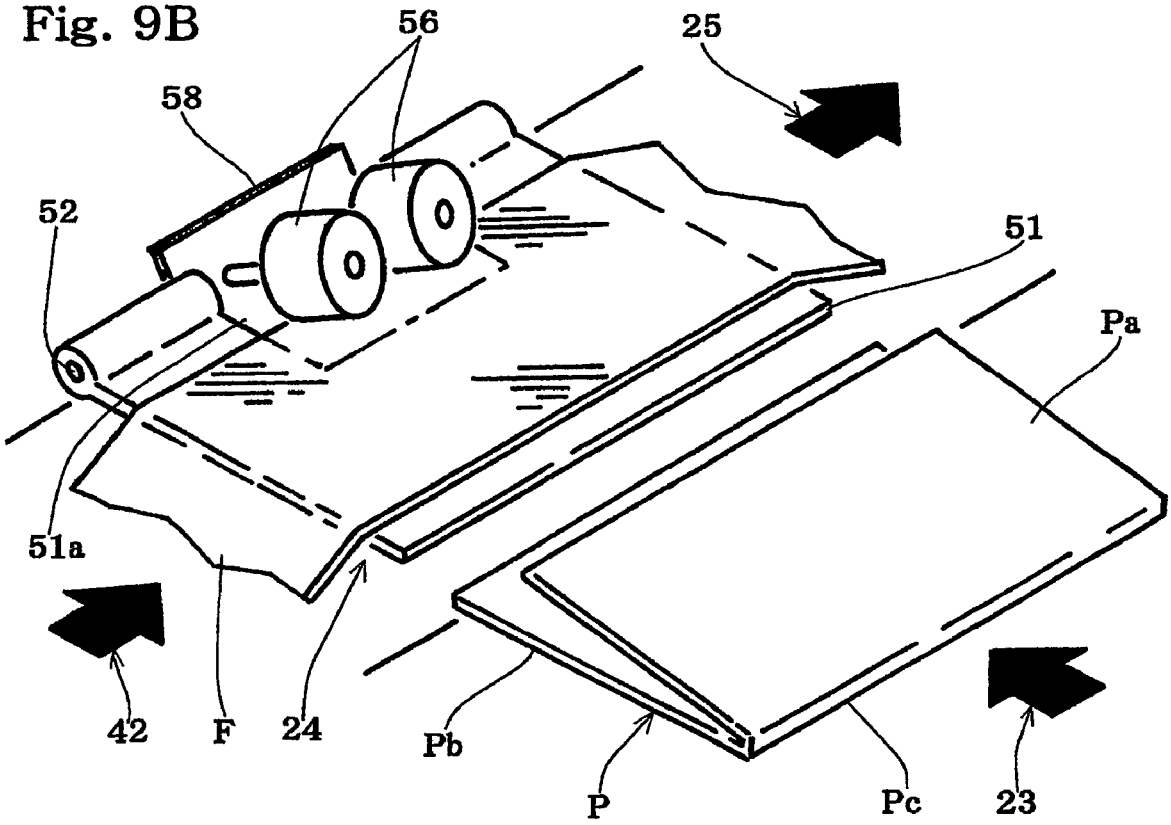
Figure 10A:
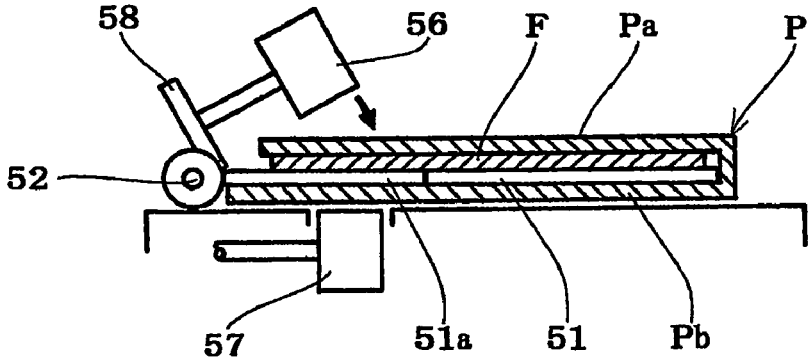
FIGS. 10A and 10B are a longitudinal cross-sectional view and a perspective view, respectively, each illustrating the main part of the support plate extracting means shown in FIGS. 9A and 9B in its stand-by condition.
Figure 10B:
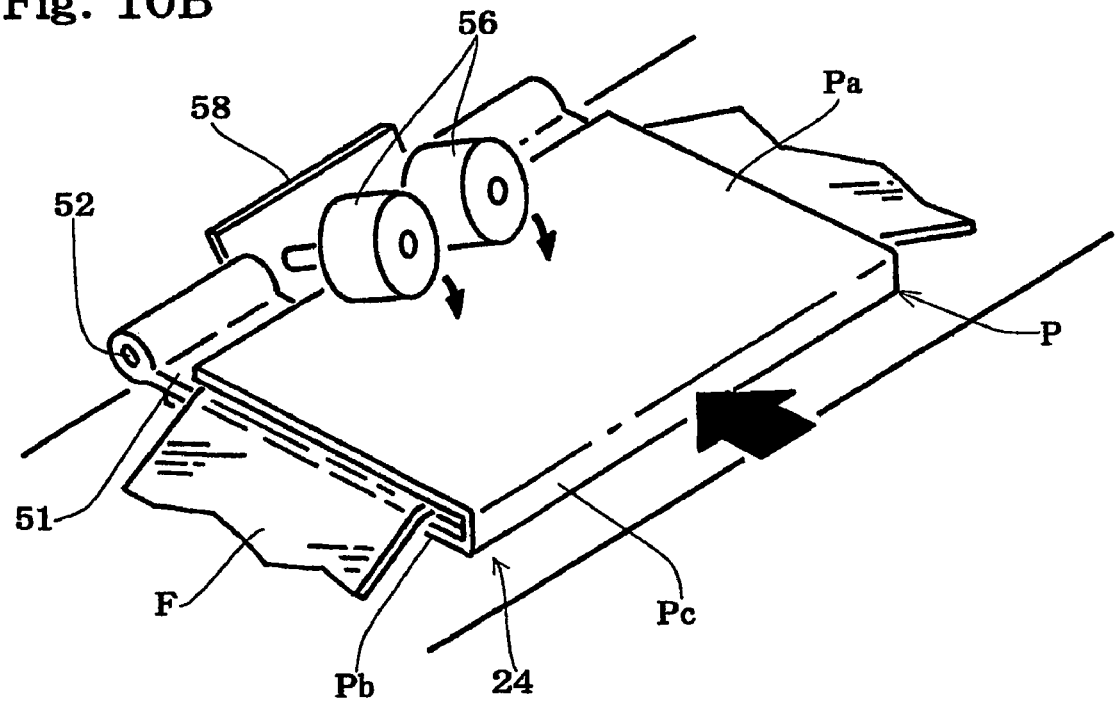
Figure 11A:
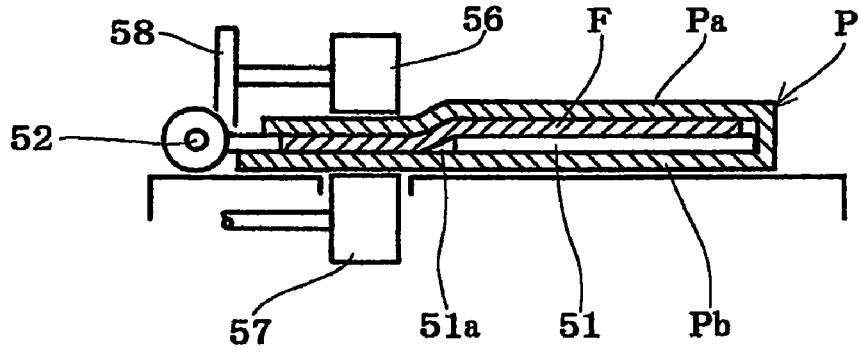
FIGS. 11A and 11B are a longitudinal cross-sectional view and a perspective view, respectively, each illustrating the main part of the support plate extracting means shown in FIGS. 9A and 9B at the start of operation.
Figure 11B:
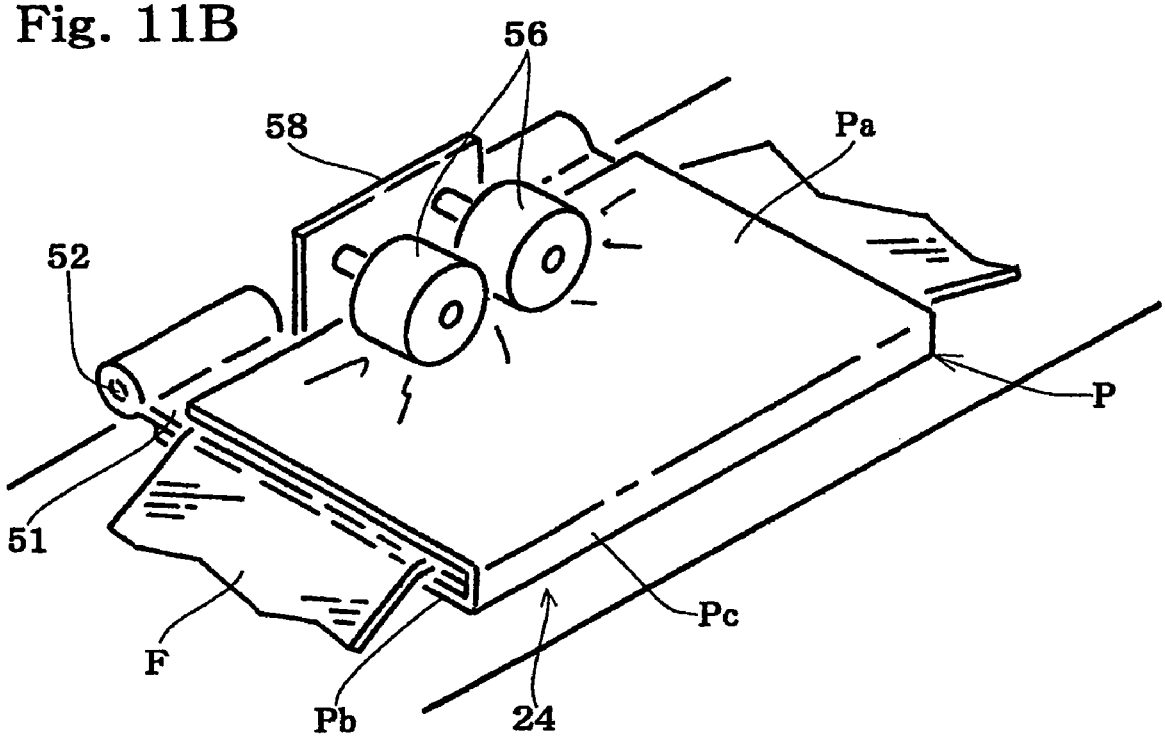

(2) Basic Structure of Contact-bonding Film Insertion Means using Support Plate and its Operation In the contact-bonding film insertion means 50, a support plate 51 made from ferromagnetic material is so supported as to be vertically movable via a support shaft 52 disposed in the same direction as that of the contact-bonding film supply path 42 as illustrated in FIGS. 7A and 7B. An electromagnet 54 constituting support plate driving means 53 is provided below the support plate 51 as illustrated in FIGS. 8A and 8B. Additionally, as illustrated in FIGS. 9A and 9B, a rectangular notch 51*a* is formed on the support plate 51, and two pairs of feed rollers 56 and 57 constituting support plate extracting means 55 are disposed above and below the support plate 51, respectively, such that the rollers 56 and 57 are opposed to each other through the notch 51*a*. In this arrangement, the feed rollers 56 positioned above are supported via a support member 58 in such a condition as to be vertically movable with respect to the feed rollers 57 positioned below.

At the intersection 24, the elongated contact-bonding film F carried on the upper surface of the support plate 51 is sequentially transferred along the contact-bonding film supply path 42 indicated by the arrow in the upper right direction, while the paper P folded into two layers is transferred with its open side directed to the front along the paper transfer path 23 indicated by the arrow in the upper left direction substantially perpendicular to the direction of the contact-bonding film supply path 42 as illustrated in FIGS. 7A and 7B.

The paper P having reached the intersection 24 has been folded by the paper folding means 30 such that the lower paper piece Pb is slightly longer than the upper paper piece Pa as illustrated in FIGS. 7A, 8A and other figures. At the intersection 24, the paper P is temporarily stopped at a position as illustrated in FIG. 8A, where the upper paper piece Pa is disposed upstream before the support plate 51 and a periphery Pbx of the lower paper piece Pb slightly enters below an periphery 51*x* of the support plate 51.

Figure 8C:
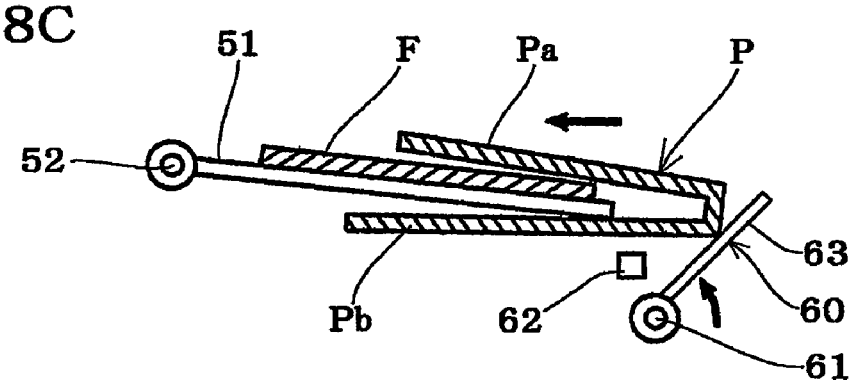

In this condition, the support plate 51 is drawn downward and simultaneously moved clockwise as indicated by a circular-arc-shaped arrow in the lower right direction around the support shaft 52 by exciting the electromagnetic stone 54 of the support plate driving means 53 disposed below the support plate 51 as illustrated in FIG. 8B. When the periphery 51*x* of the support plate 51 is lowered, the periphery Pbx of the lower paper piece Pb is pushed down by the support plate 51, thereby forcedly opening a space between the paper pieces Pa and Pb of the folded paper P. In this condition, the paper P having an open space between the paper pieces Pa and Pb is further pushed toward the support plate 51 carrying the contact-bonded film F in a left direction indicated by an arrow by means of a feed roller (not shown) which constitutes paper transfer means as well as the first half of paper pushing means 60 and a pushing bar 63 as the second half of the paper pushing means 60 attached to a support shaft 61 in such a manner as to be movable until a stopper 62 as illustrated in FIG. 8C. Then, the support plate 51 and the contact-bonding film F simultaneously start to be inserted between the paper pieces Pa and Pb. When the inner side of the folding line Pc of the paper P finally contacts the tip of the periphery 51*x* of the support plate 51, the paper P is stopped and the positioning of the paper P and the contact-bonding film F with respect to the support plate 51 is completed.

Figure 12:
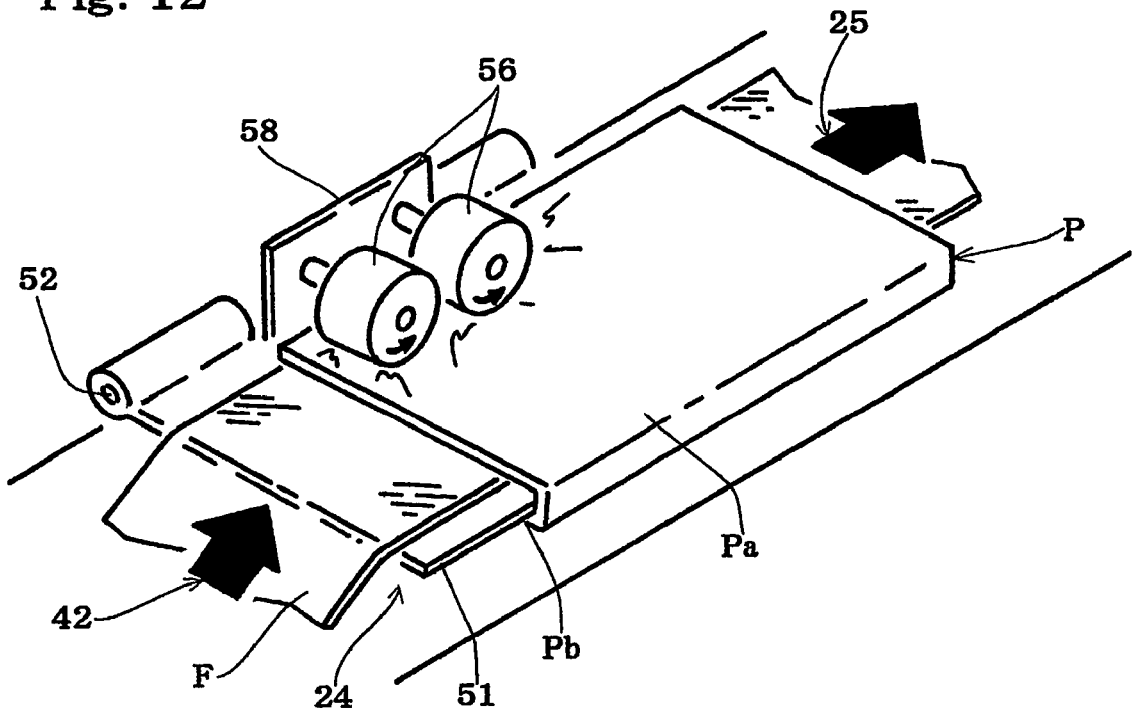
FIG. 12 is a longitudinal cross-sectional view and a perspective view illustrating a main part of the support plate extracting means shown in FIGS. 9A and 9B during operation.

Subsequently, the paper P into which the support plate 51 and the contact-bonding film F are inserted between the paper pieces Pa and Pb as described above is transferred downstream from the intersection 24 by the rotation of a pair of the feed rollers 56 and 57 included in the support plate extracting means 55 while being pressed between the feed rollers 56 and 57 as illustrated in FIGS. 10A and 10B through 12. During this process, the support plate 51 is not pressed by the feed rollers 56 and 57 since the notch 51*a* is provided as illustrated in FIGS. 11A and 11B, and thus the paper P into which only the contact-bonding film F is inserted between the paper pieces Pa and Pb is transferred downstream from the intersection 24 along the paper transfer path 25 in the upper right direction indicated by the arrow as illustrated in FIG. 12 to the paper contact-bonding means 70 and the subsequent processes illustrated in FIG. 6.

(3) Problems of Contact-bonding Film Insertion Means using Support Plate

Figure 8D:
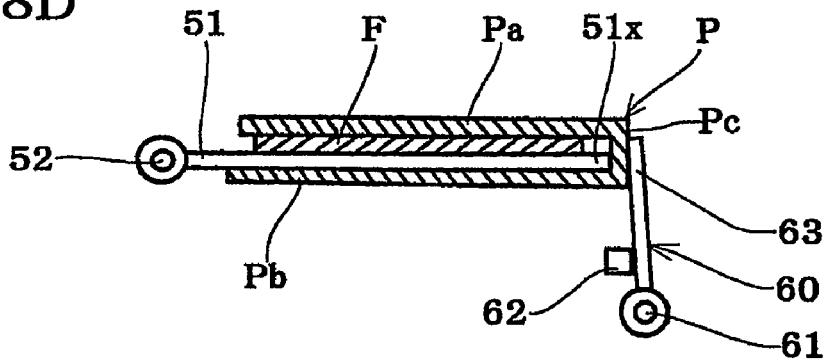

In the contact-bonding film insertion means 50 using the support plate 51 as described above, the insertion of the contact-bonding film F between the paper pieces Pa and Pb is carried out smoothly by the procedures shown in FIGS. 8C and 8D without any problem, when an open-side periphery Pax of the upper paper piece Pa of the paper P is substantially flat, has certain elasticity and extends almost straight without hanging down as illustrated in FIGS. 7A, 7B and 8A and 8B.

Figure 13:
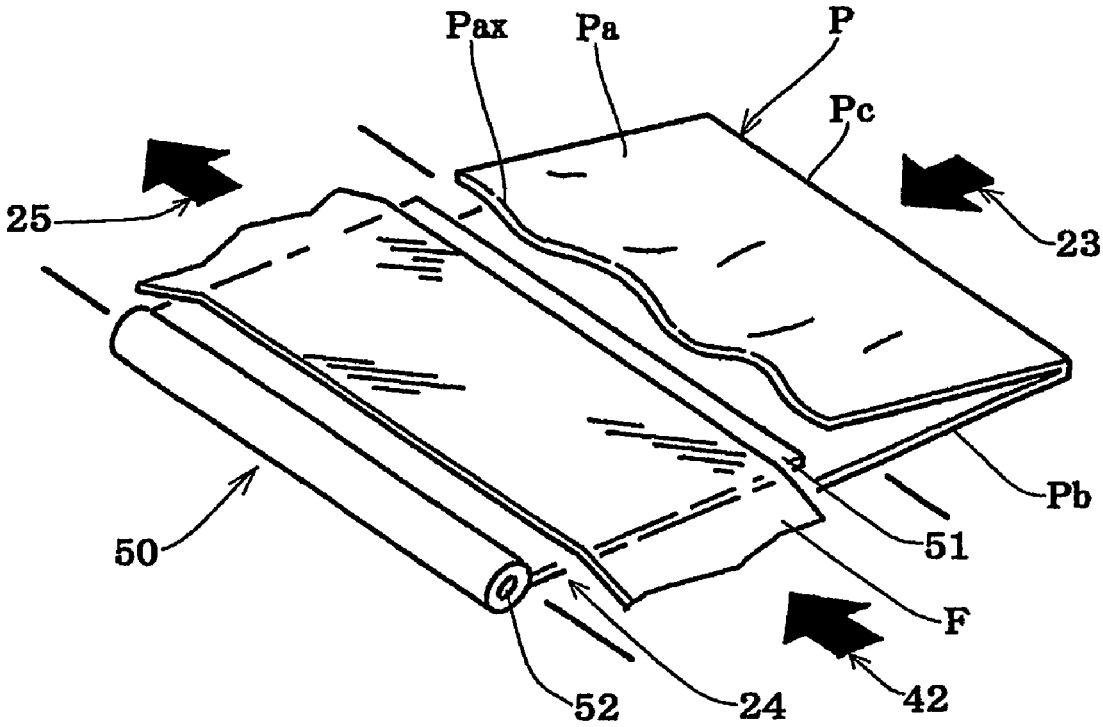
FIG. 13 is a perspective view illustrating a main part of a positional correlation between the contact-bonding film and paper in a condition that an open-side periphery of an upper paper piece of the paper is wavy and partially hangs down, as viewed from the same position as in FIG. 7B.
Figure 14A:
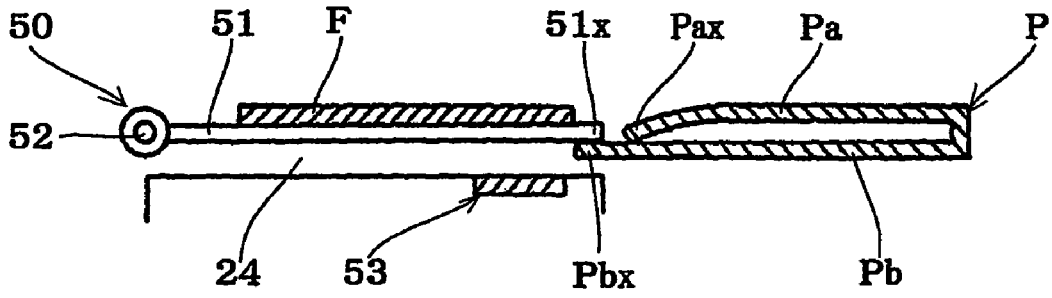
FIGS. 14A through 14C are side views each illustrating a main part of malfunction mechanism with the elapse of time, which malfunction may be caused when the paper in the condition that the open-side periphery of the upper paper piece of the paper is wavy and hangs down is used as folded paper in the contact-bonding film insertion means using a support plate which is not improved as shown in FIGS. 7A and 7B and FIGS. 8A through 8D.
Figure 14B:
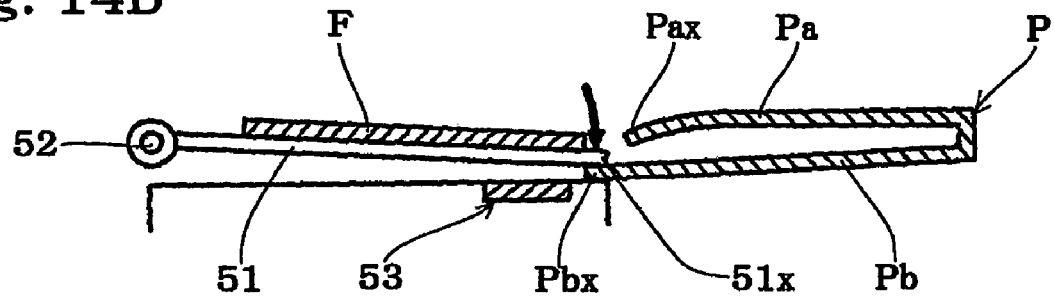
Figure 14C:
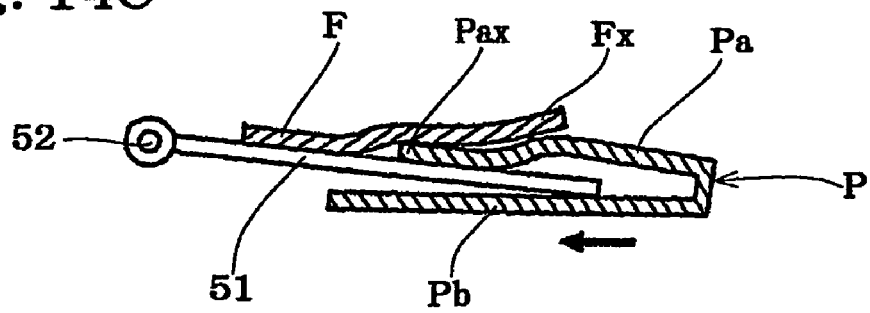

However, when the paper P is extremely curled to have concave and convex deformations on its surface through printing or other process as illustrated in FIG. 13, the periphery Pax of the upper paper piece Pa is wavy as shown in FIG. 13 at the stage when the paper P is temporarily stopped at a position where the upper paper piece Pa is disposed upstream before the support plate 51 and the periphery Pbx of the lower paper piece Pb slightly enters below the periphery 51*x* of the support plate 51 at the intersection 24. As a result, the periphery Pax hangs down toward the lower paper piece Pb as illustrated in FIG. 14A. In the next step, the support plate 51 is lowered by the support plate driving means 53 and thus the periphery Pbx of the lower paper piece Pb is pushed down by the support plate 51, but the space between the upper and lower paper pieces Pa and Pb is not sufficiently opened as illustrated in FIG. 14B. In the subsequent step, the paper P having an insufficiently opened space between the paper pieces Pa and Pb is pushed toward the support plate 51 carrying the contact-bonding film F in the left direction as indicated by the arrow by means of the paper pushing means 60 (see FIGS. 8C and 8D), but the support plate 51 carrying the contact-bonding film F is not inserted between the paper pieces Pa and Pb smoothly. Instead, for example, the hanging periphery Pax of the upper paper piece Pa is caught by a periphery Fx of the contact-bonding film F, and slides between the contact-bonding film F and the support plate 51 as illustrated in FIG. 14C or in some cases slides below the support plate 51. Consequently, jamming or other problem may arise.

Figure 1A:
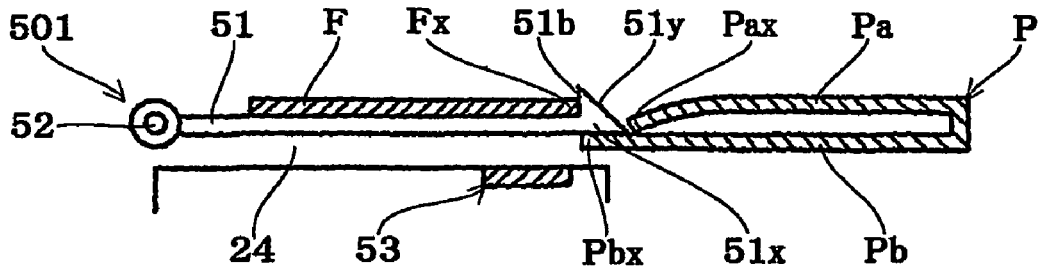
FIGS. 1A through 1C are side views each illustrating a main part of a mechanism for inserting a contact-bonding film into paper with the elapse of time in contact-bonding film insertion means in a first embodiment according the present invention.
Figure 1B:
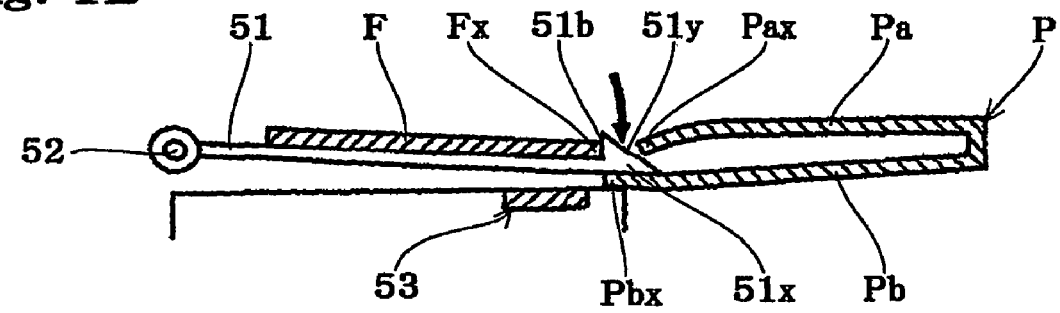
Figure 1C:
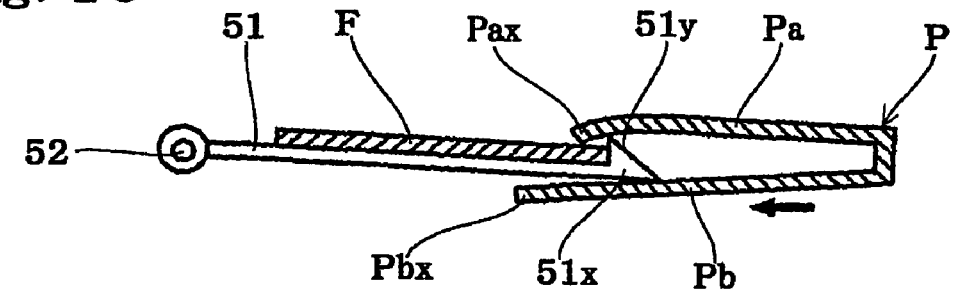

(4) Contact-bonding Film Insertion Means of a First Embodiment for Solving the Above Problem In contact-bonding film insertion means 501 in the first embodiment according to the present invention as illustrated in FIGS. 1A through 1C, a slope 51*y* is provided in the periphery 51*x* of the support plate 51 on the side to be inserted between the paper pieces Pa and Pb. The slope 51*y* has a linear cross section and is downward-inclined toward its tip to form substantially an acute angle at the tip, and extends above the periphery 51*x* of the support plate 51 and further above the periphery Fx of the contact-bonding film F placed on the support plate 51, which periphery Fx is on the side to be inserted between the paper pieces Pa and Pb, whereby the slope 51*y* has an arrow-shaped cross section. A step-shaped contact portion 51*b* for guiding the periphery Fx of the contact-bonding film F on the side to be inserted between the paper pieces Pa and Pb is also provided in the periphery 51*x* adjacent to the rear of the slope 51*y*.

More specifically, when the paper P which is curled to have concave and convex deformations on its surface is supplied to the contact-bonding film insertion means 501 which uses the support plate 51 having the above structure, the periphery Pax of the upper paper piece Pa hangs down toward the lower paper piece Pb as shown in FIG. 1A at the stage when the paper P is temporarily stopped at a position where the upper paper piece Pa is disposed upstream before the support plate 51 and the periphery Pbx of the lower paper piece Pb slightly enters below the periphery 51*x* of the support plate 51. In the next step, the periphery Pbx of the lower paper piece Pb is pushed down by the support plate 51 which is lowered by the support plate driving means 53, but the space between the upper and lower paper pieces Pa and Pb is not sufficiently opened as illustrated in FIG. 1B. In the subsequent step, however, the acute-angled tip of the slope 51*y* of the support plate 51 enters into the insufficiently opened space between the paper pieces Pa and Pb as the paper P is pushed toward the support plate 51 carrying the contact-bonding film F by means of the paper pushing means 60 (see FIGS. 8C and 8D) as illustrated in FIG. 1C. Due to the wedge shape of the slope 51*y*, the periphery Pax of the upper paper piece Pa slides on the slope 51*y* of the support plate 51, passes through the top of the slope 51*y*, and overrides the upper surface of the contact-bonding film F. As a result, the space between the paper pieces Pa and Pb is forcedly opened, and the insertion of the support plate 51 and the contact-bonding film F between the paper pieces Pa and Pb is carried out smoothly.

Figure 2A:
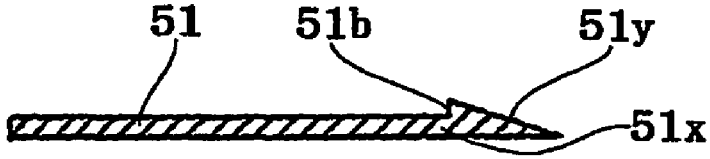
FIGS. 2A through 2G are cross-sectional views each illustrating a main part of a support plate to be employed in the contact-bonding film insertion means in the first embodiment of the invention.
Figure 2B:
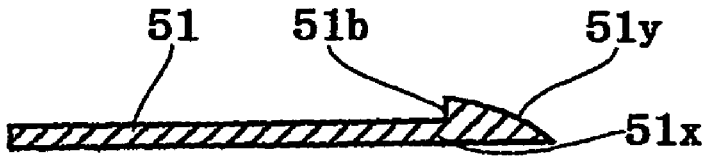
Figure 2C:
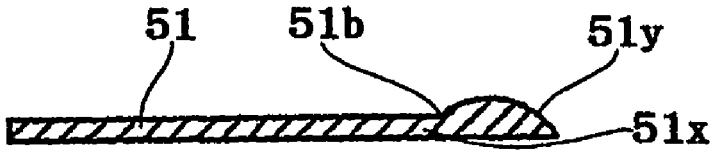
Figure 2D:
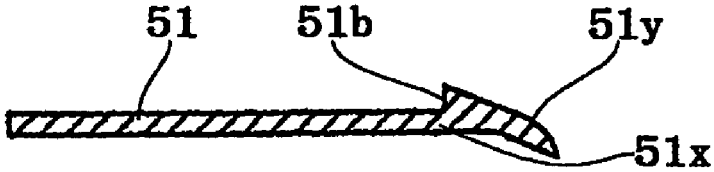

Examples of the support plate 51 which can be used in the contact-bonding film insertion means 501 in the first embodiment involve: support plates each of which includes the periphery 51*x* which is provided with the slope 51*y* having a linear cross section and has an arrow-shaped cross section as illustrated in FIGS. 1A through 1C, FIG. 2A and FIGS. 2E through 2G; and support plates each of which includes the periphery 51*x* which is provided with the slope 51*y* having a curved cross section and has an arrow-shaped cross section as illustrated in FIGS. 2B through 2D.

Figure 2E:
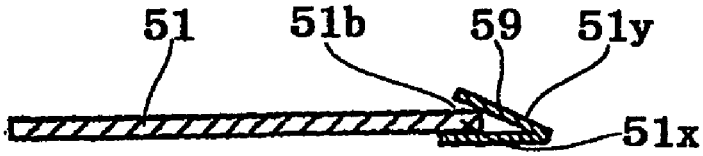
Figure 2F:
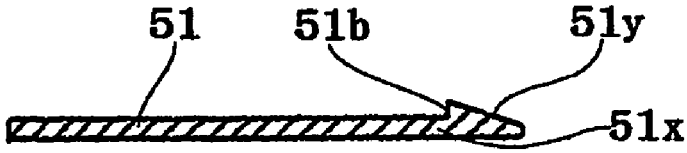
Figure 2G:
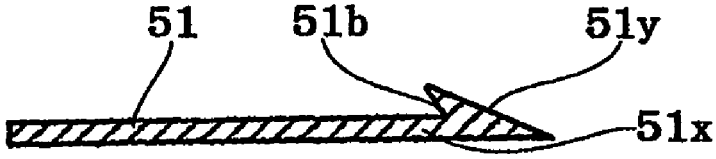

In the support plates 51 as illustrated in FIGS. 2A through 2G, each of the slopes 51*y* extends above the periphery 51*x* of the support plate 51 on the side to be inserted between the paper pieces Pa and Pb, and a step-shaped or bended contact portion 51*b* for guiding the periphery Fx of the contact-bonding film F is also provided in the periphery 51*x* adjacent to the rear of the slope 51*y*, in similar manners as illustrated in FIGS. 1A through 1C. The support plate 51 shown in FIG. 2D has the slope 51*y* that extends below the periphery 51*x*. The support plate 51 shown in FIG. 2E is provided with a separate component 59 having a wedge-shaped cross section in the periphery 51*x* and the top of the slope 51*y* is formed on the separate component 59 such that the top overhangs the upper surface of the periphery 51*x*. In the support plate 51 shown in FIG. 2F, the acute-angled tip of the slope 51 in the periphery 51*x* which has an arrow-shaped cross section shown in FIG. 2A is chamfered and/or processed to have an R shape. In the support plate 51 shown in FIG. 2G, the top of the slope 51 in the periphery 51*x* which has an arrow-shaped cross section shown in FIG. 2A overhangs the upper surface of the periphery 51*x*.

Needless to say, other examples of the support plate 51 which are modified such that each slope 51*y* of the support plates 51 shown in FIGS. 2A through 2G does not extend above the periphery 51*x* of the support plate 51 can be employed in the contact-bonding film insertion means 501, though such examples are not shown in the figures.

(5) Second Problem of Contact-bonding Film Insertion Means using Support Plate

As described above, the problem of jamming occurs when the periphery Pax of the upper paper piece Pa of the paper P hangs down as illustrated in FIG. 14A and the space between the paper pieces Pa and Pb is not completely opened even in the condition where the periphery Pbx of the lower paper piece Pb is pushed down by the support plate driving means 53 as illustrated in FIG. 14B. This problem can be solved by providing any of the slopes 51*y* shown in FIGS. 1A through 1C and FIGS. 2A through 2G in the periphery 51*x* of the support plate 51.

Figure 15:
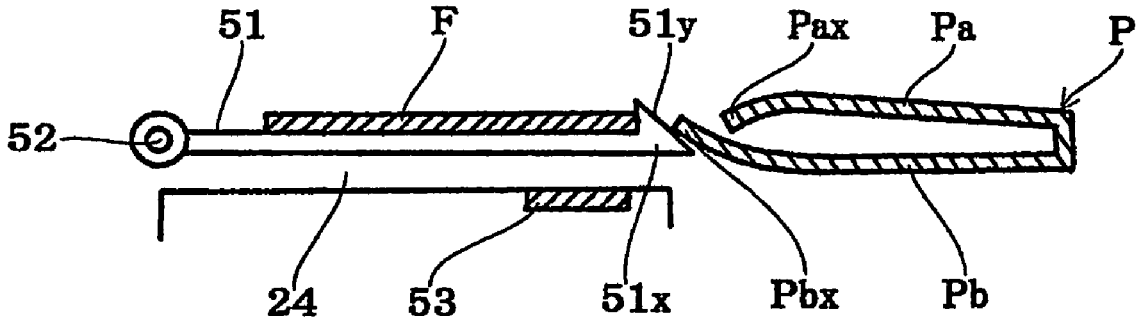
FIG. 15 is a side view illustrating a main part of malfunction mechanism with the elapse of time, which malfunction may be caused when paper in a condition that an open-side periphery of a lower paper piece of the paper is wavy and curved upward is used as folded paper in the contact-bonding film insertion means in the first embodiment of the invention as shown in FIGS. 1A through 1C.

However, when the paper P which is curled through printing and whose periphery Pbx of the lower paper piece Pb is thus curved upward is transferred to the intersection 24, the periphery Pbx of the lower paper piece Pb does not slide below the support plate 51 as desired as shown in FIG. 1A, but overrides the slope 51*y* in the periphery of the support plate 51 as illustrated in FIG. 15. As a result, the periphery Pbx of the lower paper piece Pb cannot be pushed down by the support plate driving means 53 and thus jamming is caused.

Figure 3A:
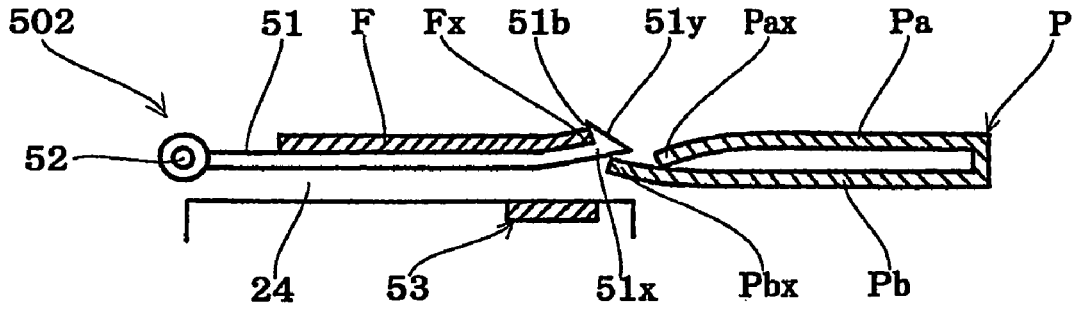
FIGS. 3A through 3C are side views each illustrating a main part of a mechanism for inserting a contact-bonding film into paper with the elapse of time in contact-bonding film insertion means in a second embodiment of the invention.
Figure 3B:
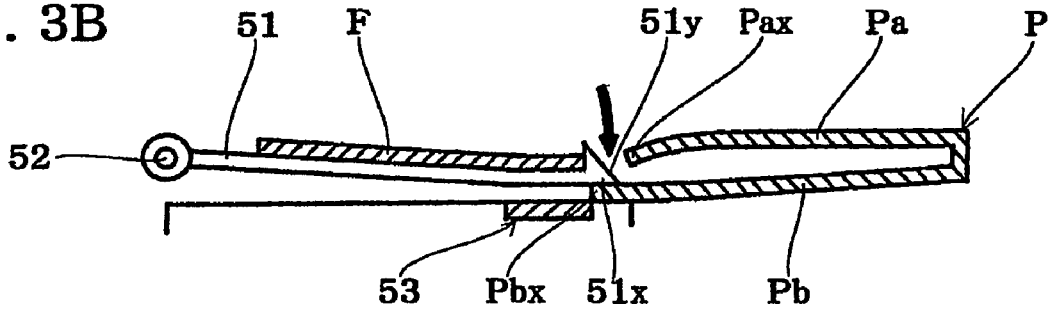
Figure 3C:
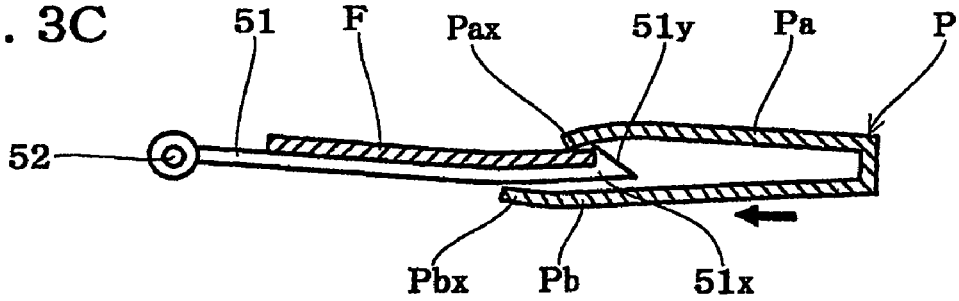

(6) Contact-bonding Film Insertion Means of a Second Embodiment for Solving the Second Problem In contact-bonding film insertion means 502 in the second embodiment, the periphery 51*x* which includes the slope 51*y* having a shape and a structure shown in FIGS. 1A through 1C is curved upward with respect to the main body of the support plate 51 as illustrated in FIGS. 3A through 3C, thereby providing a wide open space below the support plate 51.

More specifically, in the contact-bonding film insertion means 502 which includes the support plate 51 having the above structure, the lower paper piece Pb of the paper P which is folded and transferred to the intersection 24 easily slides into the wide open space below the periphery 51*x* of the support plate which is curved upward, even if the periphery Pbx of the lower paper piece Pb is curved upward as illustrated in FIG. 3A. In the subsequent step, the periphery Pbx of the lower paper piece Pb is normally pushed down by the downward movement of the support plate 51 effected by the support plate driving means 53 as illustrated in FIG. 3B. In the next step, the support plate 51 and the contact-bonding film F are smoothly inserted between the paper pieces Pa and Pb due to the wedge shape of the slope 51*y* as the paper P is pushed toward the support plate 51 carrying the contact-film F by the paper pushing means 60 (see FIGS. 8C and 8D) as illustrated in FIG. 3C, in the same manner as in the contact-bonding film insertion means 50 in the first embodiment.

Figure 4A:
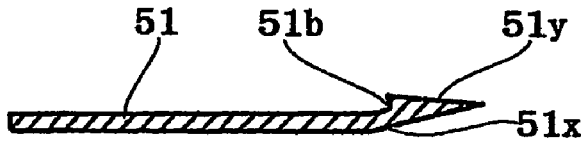
FIGS. 4A through 4H are cross-sectional views each illustrating a main part of a support plate to be employed in the contact-bonding film insertion means in the second embodiment of the invention.
Figure 4B:
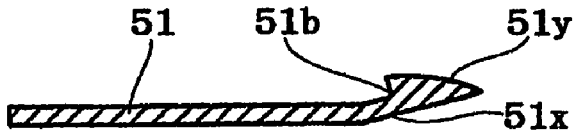
Figure 4C:
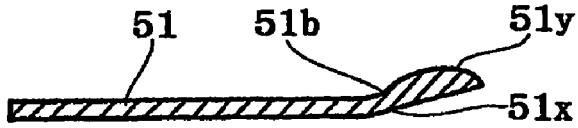
Figure 4D:
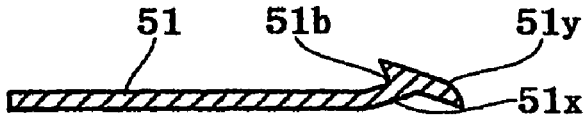
Figure 4E:
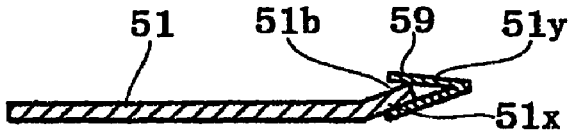
Figure 4F:
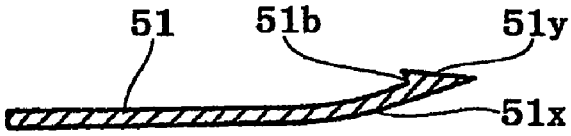
Figure 4G:
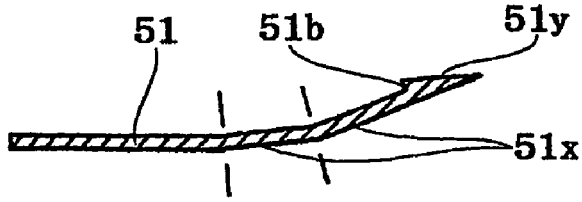
Figure 4H:
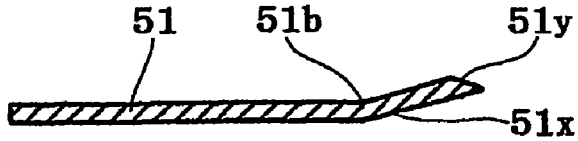

Examples of the support plate 51 which can be used in the contact-bonding film insertion means 502 in the second embodiment involve: support plates each of which includes the periphery 51*x* which is provided with the slope 51*y* shown in FIGS. 2A through 2E and is curved upward having a linear cross section as illustrated in FIGS. 4A through 4E; a support plate including the periphery 51*x* which has the slope 51*y* shown in FIG. 2A and is curved upward having a curved cross section as illustrated in FIG. 4F; a support plate including the periphery 51*x* which has the slope 51*y* shown in FIG. 2A and is curved upward at two points having a linear cross section as illustrated in FIG. 4G; and a support plate including the periphery 51*x* which has the slope 51*y* not extending above the periphery 51*x* and is curved upward having a linear cross section as illustrated in FIG. 4H. In the support plate 51 shown in FIG. 4H, the curved portion produced by curving the periphery 51*x* is utilized as the contact portion 51*b* capable of guiding the periphery Fx of the contact-bonding film F as necessary. Needless to say, it is possible to employ other examples of the support plate 51 in the contact-bonding film insertion means 502, such as those including the peripheries 51*x* which are provided with the slopes 51*y* shown in FIGS. 2F and 2G and are curved upward having linear or curved cross sections, though such examples are not shown in the figures.

(7) Contact-bonding Film Insertion Means of a Third Embodiment for Solving the Second Problem As illustrated in FIGS. 5A through 5D, contact-bonding film insertion means 503 in the third embodiment has a structure similar to that of the contact-bonding film insertion means 501 including the support plate 51 whose periphery 51*x* has the slope 51*y* having the shape and structure shown in FIGS. 1A through 1C. The periphery 51*x* of the support plate 51 in which the slope 51*y* is formed is temporarily raised by support plate raising means 65 before the lower paper piece Pb of the paper P transferred to the intersection 24 reaches the support plate 51, thereby providing a wide open space below the support plate 51 at the time when the space is required.

Figure 5A:
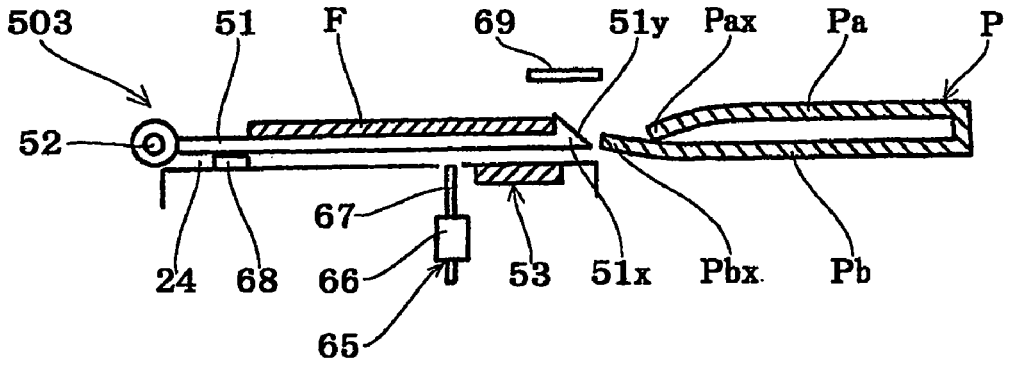
FIGS. 5A through 5D are side views each illustrating a main part of a mechanism for inserting a contact-bonding film into paper with the elapse of time in contact-bonding film insertion means in a third embodiment of the invention.
Figure 5B:
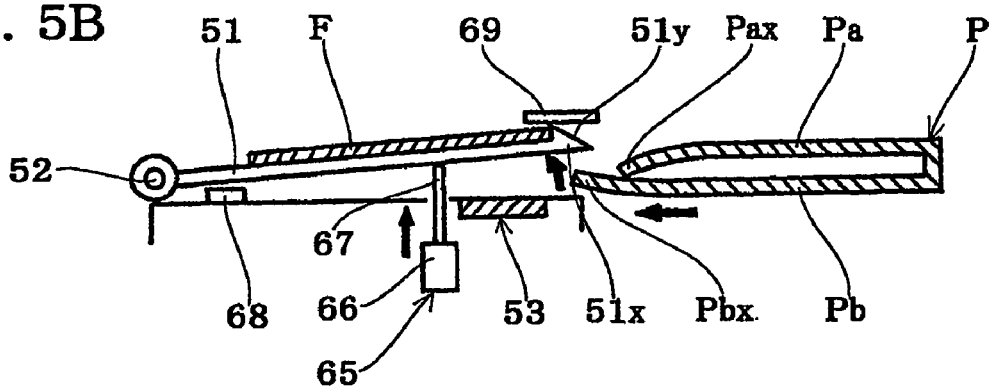
Figure 5C:
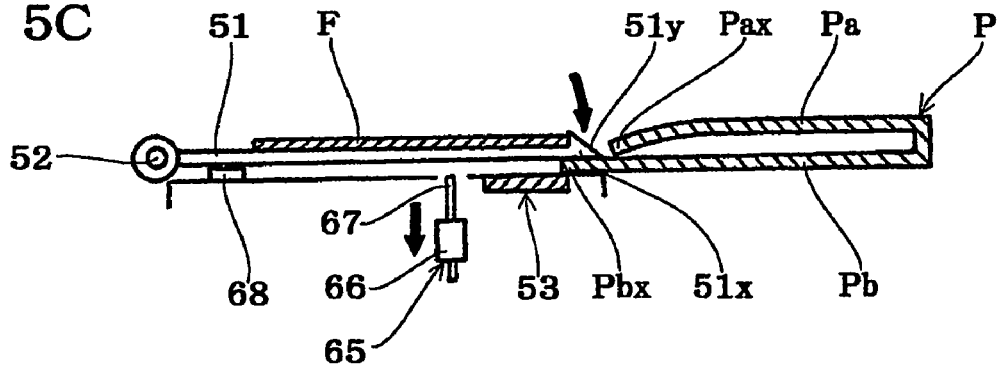
Figure 5D:
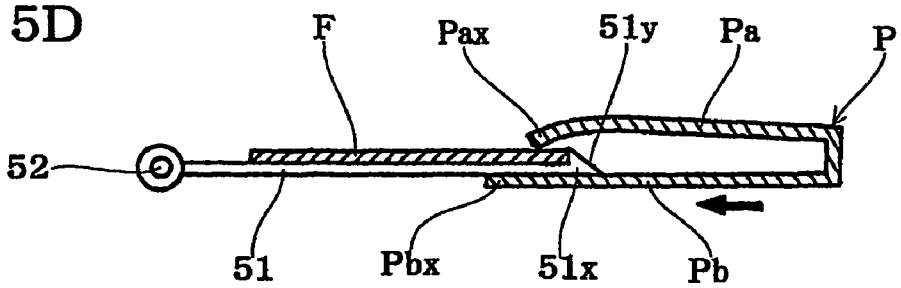

More specifically, in the contact-bonding film insertion means 503 using the support plate 51 and having the above structure, the folded paper P is transferred to the intersection 24 as illustrated in FIG. 5A. Then, a push rod 67 is raised by exciting a solenoid 66 which constitutes the support plate raising means 65 before the lower paper piece Pb of the paper P reaches the support plate 51 as illustrated in FIG. 5B. By the action of the push rod 67, the support plate 51 moves anticlockwise in an upper left direction indicated by a circular-arc-shaped arrow from the position of a lower limit stopper 68 around the support shaft 52, and the periphery 51*x* having the slope 51*y* is temporarily moved upward to an upper limit stopper 69. As a result, the lower paper piece Pb of the paper P can easily slide into the wide open space below the periphery 51*x* of the support plate 51 even if the periphery Pbx of the lower paper piece Pb is curved upward. In the subsequent step, the push rod 67 is lowered by de-exciting the solenoid 66 of the support plate raising means 65 as illustrated in FIG. 5C, and simultaneously the periphery Pbx of the lower paper piece Pb is normally pushed down by the downward movement of the support plate 51 effected by the support plate driving means 53. Accordingly, in the next step, the support plate 51 and the contact-bonding film F are smoothly inserted between the paper pieces Pa and Pb due to the wedge shape of the slope 51*y* as the paper P is pushed toward the support plate 51 carrying the contact-film F by the paper pushing means 60 (see FIGS. 8C and 8D) as illustrated in FIG. 5D, in the same manner as in the contact-bonding film insertion means 501 in the first embodiment.

While the support plate 51 included in the contact-bonding film insertion means 501 is used in the contact-bonding film insertion means 503, the support plate 51 included in the contact-bonding insertion means 502 can be also employed appropriately.

Needless to say, the above preferred embodiments of the present invention are described with the appended drawings only for better understandings of the invention, and various modifications and revisions can be made without departing from the scope and spirit of the invention.

INDUSTRIAL APPLICABILITY

As aforementioned, the contact-bonding film insertion means included in the contact-bonded paper manufacturing apparatus according to the present invention can be adopted in contact-bonded paper manufacturing apparatus using cut paper to produce direct mails, postcards, double postcards, sealed letters and so forth from cut paper. The contact-bonded paper manufacturing apparatus including the contact-bonding film insertion means is capable of manufacturing contact-bonded paper without being jammed, which paper is releasable and expandable and also conceals a large volume of information inside the paper.

The invention claimed is:

1. Contact-bonding film insertion means included in contact-bonded paper manufacturing apparatus which comprises:

paper transfer means for sequentially transferring cut paper from a paper supply section along a predetermined paper transfer path, which cut paper is formed by connecting a plurality of paper pieces with each other along folding lines;

paper folding means for folding each paper on the paper transfer path;

contact-bonding film supply means for sequentially supplying an elongated contact-bonding film along a predetermined contact-bonding film supply path, which contact-bonding film includes a two-layered transparent film whose layers are releasably bonded to each other and adhesive layers each disposed on front and back surfaces of the contact-bonding film to provide adhesion when pressurized or when heated and pressurized;

contact-bonding film insertion means for inserting contact-bonding film between any opposed paper pieces of the folded paper at an intersection of the paper transfer path downstream from the paper folding means and the contact-bonding film supply path; paper contact-bonding means for releasably bonding both the paper pieces of the paper into which the contact-bonding film is inserted, via the contact-bonding film by pressurizing or by heating and pressurizing on the paper transfer path downstream from the contact-bonding film insertion means; and paper cutting means for cutting the paper into which the contact-bonding film is inserted to a predetermined size on the paper transfer path upstream or downstream from the paper contact-bonding means, the contact-bonding film insertion means having a structure which includes:

a vertically movable support plate disposed at the intersection to carry the supplied contact-bonding film on its upper surface;

support plate driving means capable of driving the support plate in the vertical direction for lowering the support plate and the contact-bonding film as one body and thereby pushing down a lower paper piece so as to forcedly open a space between the paper pieces when the paper folded such that the lower paper piece is slightly longer than the upper paper piece is transferred to the intersection and the upper paper piece of the paper is disposed upstream from the support plate and the lower paper piece is disposed below the support plate;

paper pushing means for pushing the paper having an open space between the paper pieces to the support plate carrying the contact-bonding film and thereby simultaneously inserting the support plate and the contact-bonding film between the paper pieces; and support plate extracting means for extracting only the support plate from the paper into which the support plate and the contact-bonding film have been inserted and thereby leaving only the contact-bonding film inserted between the paper pieces, characterized in that a periphery of the support plate on the side to be inserted between the paper pieces has a slope which is downward-inclined toward the tip of the periphery to form substantially an acute angle at the tip.

2. Contact-bonding film insertion means included in contact-bonded paper manufacturing apparatus as set forth in claim 1, wherein the slope extends above the periphery of the support plate on the side to be inserted between the paper pieces.

3. Contact-bonding film insertion means included in contact-bonded paper manufacturing apparatus as set forth in claim 2, wherein the slope has a linear and/or curved cross section.

4. Contact-bonding film insertion means included in contact-bonded paper manufacturing apparatus as set forth in claim 2, wherein the slope is formed by a separate component attached to the periphery of the support plate.

5. Contact-bonding film insertion means included in contact-bonded paper manufacturing apparatus as set forth in anyone of claim 2, wherein the tip of the slope provided in the periphery is chamfered or processed to have an R shape.

6. Contact-bonding film insertion means included in contact-bonded paper manufacturing apparatus as set forth in claim 2, wherein a contact portion for guiding a periphery of the contact-bonding film on the side to be inserted between the paper pieces is provided adjacent to the rear of the slope.

7. Contact-bonding film insertion means included in contact-bonded paper manufacturing apparatus as set forth in claim 1, wherein the slope has a linear and/or curved cross section.

8. Contact-bonding film insertion means included in contact-bonded paper manufacturing apparatus as set forth in claim 7, wherein the slope is formed by a separate component attached to the periphery of the support plate.

9. Contact-bonding film insertion means included in contact-bonded paper manufacturing apparatus as set forth in anyone of claim 7, wherein the tip of the slope provided in the periphery is chamfered or processed to have an R shape.

10. Contact-bonding film insertion means included in contact-bonded paper manufacturing apparatus as set forth in claim 7, wherein a contact portion for guiding a periphery of the contact-bonding film on the side to be inserted between the paper pieces is provided adjacent to the rear of the slope.

11. Contact-bonding film insertion means included in contact-bonded paper manufacturing apparatus as set forth in claim 1, wherein the slope is formed by a separate component attached to the periphery of the support plate.

12. Contact-bonding film insertion means included in contact-bonded paper manufacturing apparatus as set forth in anyone of claim 7, wherein the tip of the slope provided in the periphery is chamfered or processed to have an R shape.

13. Contact-bonding film insertion means included in contact-bonded paper manufacturing apparatus as set forth in claim 11, wherein a contact portion for guiding a periphery of the contact-bonding film on the side to be inserted between the paper pieces is provided adjacent to the rear of the slope.

14. Contact-bonding film insertion means included in contact-bonded paper manufacturing apparatus as set forth in claim 1, wherein the tip of the slope provided in the periphery is chamfered or processed to have an R shape.

15. Contact-bonding film insertion means included in contact-bonded paper manufacturing apparatus as set forth in claim 14, wherein a contact portion for guiding a periphery of the contact-bonding film on the side to be inserted between the paper pieces is provided adjacent to the rear of the slope.

16. Contact-bonding film insertion means included in contact-bonded paper manufacturing apparatus as set forth in claim 1, wherein a contact portion for guiding a periphery of the contact-bonding film on the side to be inserted between the paper pieces is provided adjacent to the rear of the slope.

17. Contact-bonding film insertion means included in contact-bonded paper manufacturing apparatus as set forth in claim 1, wherein the periphery having the slope is curved upward with respect to the main body of the support plate.

18. Contact-bonding film insertion means included in contact-bonded paper manufacturing apparatus as set forth in claim 17, wherein the periphery having the slope is curved to have a linear and/or curved cross section.

19. Contact-bonding film insertion means included in contact-bonded paper manufacturing apparatus as set forth in claim 1, wherein the periphery of the support plate in which the slope is formed is temporarily raised by support plate raising means before the lower paper piece of the paper transferred to the intersection reaches the support plate.

20. Contact-bonding film insertion means included in contact-bonded paper manufacturing apparatus as set forth in claim 19, wherein the support plate raising means raises the support plate using a push rod which is disposed below the support plate and driven by driving means.

* * * * *